United States Patent [19]

Barsby et al.

[11] Patent Number: 4,923,015

[45] Date of Patent: May 8, 1990

[54] EARTH MOVER BLADE STABILIZING APPARATUS

[76] Inventors: James B. Barsby, 13116 LaJolla Cir., La Mirada, Calif. 90638; Tiodoro Mondoy, 13551 Destino St., Cerritos, Calif. 90701

[21] Appl. No.: 252,546

[22] Filed: Oct. 3, 1988

[51] Int. Cl.[5] ..... E02F 3/76; A01B 63/111

[52] U.S. Cl. ..... 172/4.5; 33/366

[58] Field of Search ..... 172/2, 4.5; 33/366

[56] References Cited

U.S. PATENT DOCUMENTS

| | | | |
|---|---|---|---|
| 3,236,535 | 2/1966 | Barber | 280/6.1 |
| 3,831,683 | 8/1974 | Ikeda et al. | 172/4.5 |
| 3,899,028 | 8/1975 | Morris et al. | 172/4.5 |
| 4,024,823 | 5/1977 | Ward et al. | 172/4.5 |
| 4,085,805 | 4/1978 | Hawkins et al. | 172/4.5 |
| 4,157,118 | 6/1979 | Suganami et al. | 172/2 |
| 4,213,503 | 7/1980 | Elmberg et al. | 172/4.5 |
| 4,282,933 | 8/1981 | Suganami et al. | 172/4.5 |
| 4,431,060 | 2/1984 | Scholl et al. | 172/2 |
| 4,524,836 | 6/1985 | Pehrson | 172/2 |
| 4,529,039 | 7/1985 | Sakundiak | 172/2 |
| 4,535,847 | 8/1985 | Hasegawa et al. | 172/2 |
| 4,557,056 | 12/1985 | Kim et al. | 33/366 |
| 4,561,299 | 12/1985 | Orlando | 33/366 X |
| 4,829,418 | 5/1989 | Nielsen et al. | 172/4.5 X |

FOREIGN PATENT DOCUMENTS

| | | | |
|---|---|---|---|
| 107205 | 6/1984 | Japan | 33/366 |
| 8504708 | 10/1985 | PCT Int'l Appl. | 33/366 |
| 1290535 | 9/1972 | United Kingdom | 172/4.5 |
| 2167191 | 5/1986 | United Kingdom | 33/366 |

OTHER PUBLICATIONS

"Cat Automatic Blade Control" brochure, Caterpillar Tractor Company, Oct. 1979.

*Primary Examiner*—Randolph A. Reese
*Assistant Examiner*—Jeffrey L. Thompson
*Attorney, Agent, or Firm*—Fulwider, Patton, Lee & Utecht

[57] ABSTRACT

An earth mover blade stabilizing system for maintaining the blade height constant independent of a change in the earth mover's pitch angle. A damped pendulum having a magnetic end moving between two LOHET sensors generates a signal which is used to control the earth mover's hydraulic blade actuation system. An electronic biasing means is provided by which the blade height can be incrementally repositioned to facilitate an automatic grading of a surface to a predetermined slope angle.

16 Claims, 2 Drawing Sheets

FIG. 1
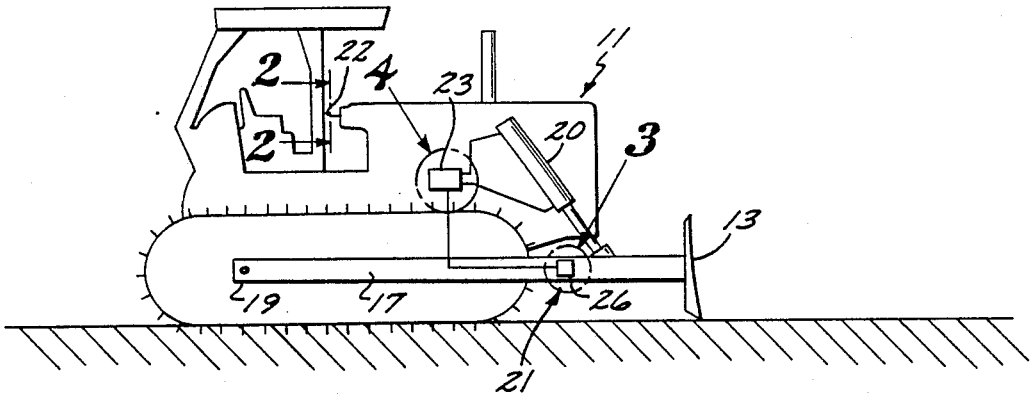
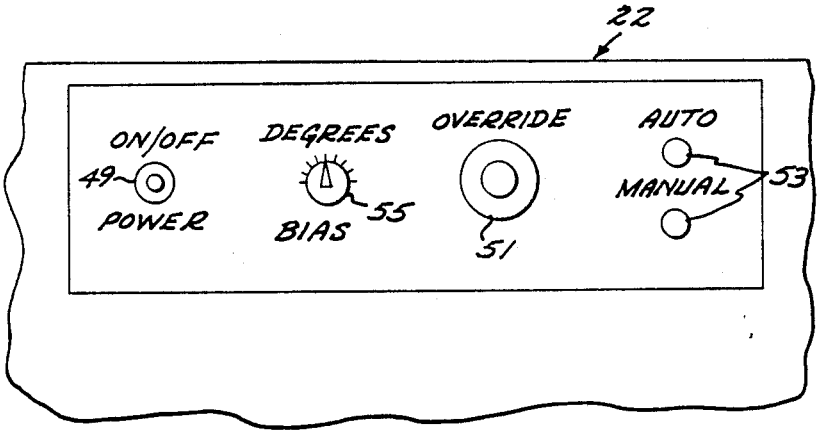
FIG. 2

EARTH MOVER BLADE STABILIZING APPARATUS

BACKGROUND OF THE INVENTION

The present invention relates generally to earth moving equipment and more particulary pertains to a system for automatically maintaining an earth mover's blade height constant independent of the earth mover's change in pitch angle.

Earth moving equipment is often called upon to perform ground conditioning operations such as the preparation of accurately finished substantially flat ground surfaces. The accuracy required for the production of building lots or for road grading requires a high degree of skill in the operation of the earth moving equipment. It is especially difficult to manually keep the blade of a bulldozer at a controlled, substantially fixed level as the bulldozer body is subjected to pitching when traversing a rugged ground surface. Underskilled operation of a bulldozer over a rugged terrain can actually cause the surface to become even more uneven as the bulldozer rides up over high spots and down through low spots with commensurate changes in blade height and inclination. In order that a rugged ground surface may be flatly bulldozed, an operator is required to operate an operating lever of the bulldozer to control the earth removing blade thereof while the operator carefully investigates the state of that portion of the ground surface which is located forwardly of the earth removing blade and which is included in the dead angle of sight as viewed from a normal operating position and while the operator watches the movement of the earth removing blade relative to the rugged ground surface. Problems are compounded when grading a surface to a predetermined slope angle. It takes a great amount of time for a man to become skilled in such a complicated control operation. The blade control operation is particularly difficult and requires highly skilled technique when the bulldozer moves at a higher speed.

A variety of systems have been disclosed that automatically control the operation of the blade. Relatively elaborate devices utilizing inertial systems or remote points of reference enable a substantially flat or level surface to be produced with a minimum of operator intervention. On the other hand, it has been found that devices which serve to merely stabilize the blade relative to the horizontal provide sufficient control to yield satisfactory results. Such blade stabilizers thereby provide a relatively inexpensive alternative to systems employing laser guidance or inertial techniques.

Typically, the stabilizing systems employ an inclinometer in one form or another to measure the angle of the blade relative to the horizontal. Output from the inclinometer is interpreted accordingly and ultimately employed to control the hydraulics that operate the blade. The conditions under which these devices are called to function are harsh. While in operation, a piece of earth moving equipment experiences extremes in vibration, shockloads, temperature and contamination. To provide satisfactory performance, the control devices must withstand the same adverse conditions while providing continuous and reliable control.

The device described in U.S. Pat. No. 4,524,836 relies on a tilt vial to supply information regarding a blade's angular deviation from a predetermined value. Such a tilt vial typically takes the form of a mercury switch in which a closed capsule is substantially but not completely filled with the electrically conductive liquid. Any deviation from the horizontal causes the liquid to flow to one end of the capsule where it serves to close one of the two diametrically opposed electric circuits. The disadvantage inherent in such a sensor is that vibration and shock loading causes the liquid level to fluctuate wildly within the capsule thereby causing both electric circuits to open and close intermittently. Furthermore the signals produced by such a device are limited to a binary output which provides no information regarding the magnitude of the deviation. Consequently, the hydraulic actuators can only be controlled in a rather coarse fashion which may afford erratic operation.

U.S. Pat. No. 4,535,847 discloses a inclinometer employing a float and proximity switches. This design suffers from similar shortcomings in that it is adversely affected by shock and vibration and is capable of providing only binary information.

The device described in U.S. Pat. No. 4,024,823 employs a manometer in concert With a light source and photocells. The manometer is positioned such that the level of an opaque fluid therein varies as a function of the blade height. The level of the opaque fluid rises and falls between the light source and the photocells, consequently the higher the fluid level the lower the photoelectric output. While this does provide linear information regarding the magnitude of angular deviation from the horizontal, it is a rather complex and delicate apparatus that seems ill-suited for use on an earth mover. U.S. Pat. No. 3,831,683 employs gyroscopes which add an undesirable amount of complexity to such a device. An increased degree of complexity augments many of the above-indicated typical shortcomings of the prior art. Besides increasing the cost of manufacture, more parts and complex interactions thereof increase their susceptibility to failure due to vibration, shock, temperature and contamination.

The size and bulk of some of these prior art devices poses further problems. As it is usually necessary for such devices to be positioned on or about the earth mover blade's actuation system and it is desirable that the device be located substantially out of harm's way, it is most advantageous that its overall dimensions be minimized. Difficulties associated with size and bulk are compounded for devices intended for retrofit applications where no special niches had been provided on the earth mover.

SUMMARY OF THE INVENTION

The general purpose of this invention is to provide an automatic earth mover blade stabilizing system that is extremely simple, rugged, small, reliable and capable of imparting a very fine degree of control. To attain this, the present invention provides an inclinometer adjustably mounted to one of the earth mover blade control arms. The inclinometer employs a dampened pendulum having a magnetic end that pivots between two solid state sensors capable of emitting a electric signal proportional to the magnitude and direction of the pendulum's displacement from the vertical. This output is appropriately combined and amplified and used to control a proportioning valve that feeds hydraulic pressure to the hydraulic actuators used to control the earth mover's blade. The entire pendulum and sensor assembly can be rotated relative to the control arm to establish a new set point which is henceforth perceived as vertical and consequently serves to alter the blade height that is to be maintained. In addition, the output can be electronically biased to electronically adjust the blade set height.

Such a system in general and the solid state sensing system in particular is substantially unaffected by shock, vibration or temperature fluctuations and extremes and can be completely sealed to insulate it from contamination. As a result, the system of the present invention is capable of delivering reliable results throughout a long service life. Its relatively small size and low cost renders the device especially well suited for retrofit applications.

These and other features and advantages of the invention will become apparent from the following more detailed description, when taken in conjunction with the accompanying drawings, which illustrate, by way of example, the features of the invention.

BRIEF DESCRIPTION OF THE DRAWINGS

FIG. 1 is a side elevational view of an earth mover incorporating the blade stabilizing apparatus of the present invention;

FIG. 2 is a plan view, in enlarged scale, of a control station layout employed in the stabilizing apparatus, shown in FIG. 1; and ;

DESCRIPTION OF THE PREFERRED EMBODIMENT

Figure 3:
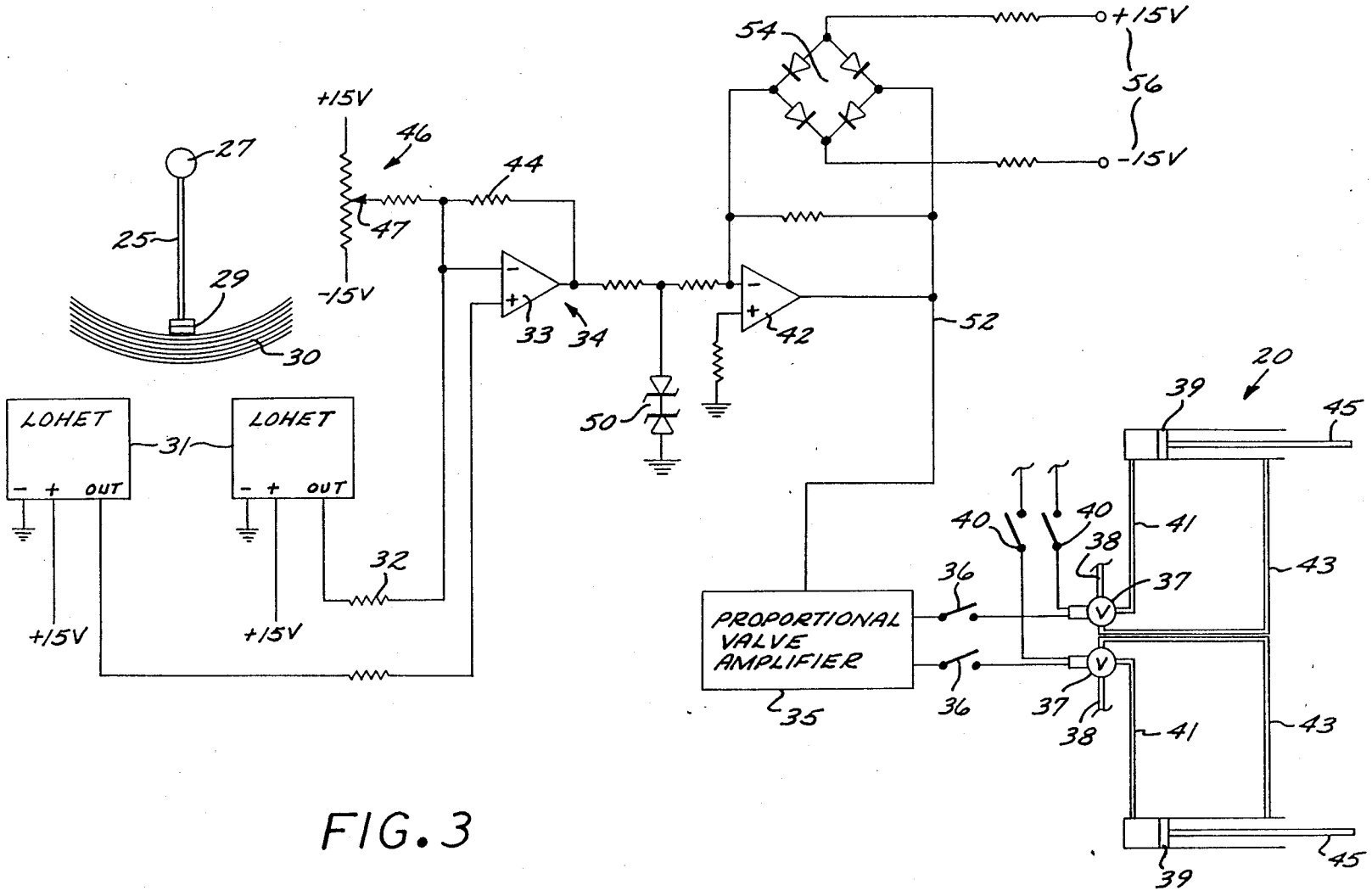
FIG. 3 is a schematic representation of the entire blade stabilizing apparatus of the present invention.

Reference is made to FIG. 1 which illustrates an earth mover incorporating the blade stabilizing system of the present invention. Generally, the earth mover is depicted here as a tracked bulldozer 11, having a movable blade 13 mounted to the front thereof by means of support arms 17 pivoted at their rear extremities about a transverse pivot axis 19. The height of the blade is controlled by hydraulic actuators, which may for example employ double acting hydraulic cylinders 20 to drive the front ends of the arms 17 upwardly or downwardly. The system of the present invention provides for the height of the blade to be controlled automatically. Once set, a particular blade height, or more specifically the control arms' angle relative to the horizontal, is maintained without operator intervention despite any pitching the bulldozer may encounter while traversing rugged terrain. A control station, generally designated 22 (FIG. 2), disposed within the operator's reach allows the system's functions to be conveniently controlled and monitored.

Major operative components of the stabilizing system include, generally, the inclinometer 21 and a hydraulic amplifier 35 (FIG. 3). The inclinometer is necessarily affixed to an element whose position is directly related to the movement of the blade and more specifically whose angle relative to the horizontal varies and is a direct function of the blade height. In the illustrated example, the inclinometer 21 is directly affixed to one of the control arms 17. Any change in the height of blade 13 is translated into an angular deflection within inclinometer 21 as control arm 17 pivots about pivot axis 19. Conversely, the change in the pitch of the entire bulldozer 11 may have a similar effect on the angular deflection of control arm and consequently is measurable by the inclinometer 21.

The inclinometer is schematically represented in FIG. 3 and includes a housing 26 (FIG. 1) pivotally mounted from one of the control arms 17 and suspending therein a pendulum 25 by means of a bearing for pivoting about a transverse pivot arm 27. The free end of the pendulum is magnetized as for example by the attachment of a permanent magnet 29 thereto. The magnetic field generated by the presence of the magnet 29 is generally depicted by reference numeral 30. A pair of sensors 31 are mounted from the housing 26 to be positioned on either side of a transverse vertical plane through the pendulum axis 27 so as to detect the presence and magnitude of the magnetic field 30. A type of sensor particularly well suited for the present invention is a linear output Hall Effect tranducer (LOHET). Such a sensor is a solid state electronic device operative to produce an electric signal proportional to the strength of the magnetic field to which it is subjected. As the pendulum 25 swings or is moved forwardly or rearwardly toward one of the transducers, the resulting signal generated by that transducer may increase in magnitude while that of the other transducer decreases. In its vertical position the pendulum 25 is disposed equidistant from both sensors and consequently both LOHETs sense and produce nominally identical signals.

The entire sensor assembly, including the pendulum 25 and both LOHETs 31, is sealed within the contamination proof housing 26 which is filled with a dampening fluid. The fluid serves to dampen the motion of the pendulum such that shock loads or vibration do not substantially affect the output of the two LOHETs. A stabilized output provides a more accurate indication of the true angle of the inclinometer relative to the vertical.

The housing 26 is adjustably mounted from one of the arms 17 by means of a journal housing a transverse axis of rotation coincident with the axis of rotation 27 of the pendulum 25 and parallel to the axis of rotation of the arm 17. Thus, the rotational position of the housing 26 may be mechanically adjusted relative to the vertical to thus adjust the position of the sensors relative to the magnetic end of the pendulum 25 to thereby adjust the null setting and, consequently, the height of the blade relative to the horizontal plane.

With continued reference to FIG. 3, the outputs from the respective LOHETs are connected through respective resistors 32 to the respective positive and negative input terminals of an operational amplifier 33 arranged in a differential configuration. Consequently the amplifier output is a function of the magnitude of the difference between the two LOHET signals. A maximum positive signal is generated when the pendulum swings to one extreme while a maximum negative signal is generated when the pendulum swings to the opposite extreme. When the pendulum is vertical a minimum signal results, nominally equal to zero volts.

A feedback resistor 46 is connected across the operational amplifier 33 and is interconnected with the wiper 47 of a potentiometer, as illustrated in FIG. 3. The wiper is controlled by a bias control knob 55 mounted on the control panel 22. The position of the bias knob is preferably calibrated to a scale corresponding to a grade angle, for example in 1° increments.

The output 34 of the operational amplifier 33 is fed to operational amplifier 42 in a unity gain configuration that serves to stabilize the output from amplifier 33 as influenced by the feedback circuitry 46. The diode bridge 54 in conjunction with a power source 56, has an additional stabilizing effect by broadening the "0" voltage output of amplifier 33. In addition, the two Zener diodes 50 arranged in a back-to-back configuration serve to limit the output voltage at point 52 in the circuit to a voltage compatible with the proportional valve amplifier 35.

The buffered, stabilized and voltage limited output 52 is fed to proportional valve amplifier 35 through respective override switches 36. Such amplifier serves to translate the incoming drive signal to a specific setting of proportional solenoid valves 37 that control flow to the opposite ends of the respective hydrualic cylinders 20. The solenoids of the hydraulic valves 37 are also connected with manual override switches 36. Such manual override switches are, in practice, ganged together with the stabilizer override switches and coupled with an override control button 51 mounted on the control panel 22 (FIG. 2).

The inlets to the respective valves 37 are connected with a hydraulic pump by means of respective supply lines 38. One outlet of each valve is connected with the blind end of the respective cylinders 20 by means of respective lines 41 and the second outlet of each is connected with the piston side thereof by means of respective lines 43. Thus the pistons 39 and associated piston rods 45 are driven in and out to a degree and at a rate dictated by the signal received from the amplifier 35.

Also mounted on such control panel 22 is an actuation button 49 and the override button 51 which are operative, respectively, to actuate the stabilizing system and to override it.

In operation, the operator actuates the hydraulic cylinders 20 to set the blade 13 to a desired height. He or she can then loosen the fasteners holding the inclinometer housing 26 in its set position to free it for rotation about the axis 27. He will then manually rotate such housing to dispose the sensors 31 equidistant on either side of the magnet 29 to attain a "set" or "null" position. From henceforth that particular position of the blade is perceived as the set point. Upon energizing the system via the control station, that particular position of the blade, i.e., the angle of the control arm relative to the horizontal, will be maintained irrespective of the pitch angle or pitch angle changes of the bulldozer 11.

If the bulldozer were to then suddenly encounter a surface which causes its front end to rise the pendulum will swing towards one of the LOHETs 31. That particular LOHET output will increase while the opposing LOHET's output will decrease. The operational amplifier 33 in the differential configuration will calculate the difference between the two outputs and said output will be fed to the proportioning valve amplifier 35. The proportioning valve amplifier causes valves 37 to feed pressurized fluid to feed lines 41 causing the hydraulic actuators to extend and adjust the blade downwardly to compensate for the change in pitch of the bulldozer. Conversely, if the bulldozer's front end were to drop, the pendulum would swing in the opposite direction causing one LOHET's output to increase and the other one to decrease. Their difference measured via the operational amplifier will be fed to the proportioning valve amplifier 35 which causes the hydraulic valves 37 to feed pressure to pressure lines 43 causing a retraction of the hydraulic actuators, and thereby causing the blade to rise.

Should the operator desire to operate the blade manually, actuation of the override button 51 on the control station disconnects the input from the stabilizer system and allows the hydraulics to be activated manually. The indicator lamps on 53 on the control station show whether the system is in an automatic or a manual mode.

In the event the operator elects to make small adjustments to the set of the blade, the bias knob 55 can be manipulated to electronically alter the signal emanating from the operational amplifier by adjusting the voltage applied at 47. This allows the operator to quickly reset the blade height without readjusting the position of the inclinometer.

An illustrative example of how this system can be employed to produce a flat building lot is as follows. The bulldozer's blade height is adjusted such that a level cut results, i.e. the bottom edge of the blade is substantially level with or slightly below the plane defined by the bottom of the bulldozer's tracks. The inclinometer is zeroed so as to define that position of the control arm as the set point and the system is activated. The operator then causes the bulldozer to proceed across the surface at any desired bearing, distance or velocity until all irregularities have been evened out. No operator intervention is required to control the blade height. If it is desired, for example, to "build in" a 2° slope angle to facilitate drainage, the bias knob is rotated to the appropriate position and the operator causes the bulldozer to proceed across the surface parallel to the desired fall line. When proceeding forwardly down the fall line, the bias knob is set at, for instance, −2° to scrape a grade of 2° from the horizontal. When the bulldozer is then turned to proceed forwardly up the fall line, the bias knob will be switched to +2° to maintain the desired 2° grade. Alternatively, the setting of the knob need not be altered if the bulldozer alternately forwards and reverses up and down the fall line.

From the foregoing, it will be apparent that the blade stabilizing apparatus of the present invention provides a durable and inexpensive means for automatically controlling the relative height of the blade of an earth mover.

Various modifications and changes may be made with respect to the foregoing detailed description without departing from the scope of the present invention.

What is claimed is:

1. An earth mover blade stabilizing apparatus for controlling the height of a blade carried from an earth mover by means of pivoted arm means rotatable about a transverse mounting axis and driven by a hydraulic cylinder, said apparatus comprising:

an inclinometer including a housing mounted on said arm means in a predetermined transverse plane and including sensor means disposed within said housing, said inclinometer further including a pendulum mounted from said housing for rotation about a pendulum axis disposed in said transverse plane, said pendulum naturally assuming a true vertical position not necessarily coplanar with the predetermined transverse plane, and including on the free end of said pendulum a magnetic element for generating a magnetic field, said sensor means for sensing said magnetic field, and operative in response to the location of said magnetic element on first and second sides of said predetermined transverse plane to produce respective first and second deviation signals of proportionate magnitude indicative of the position of said magnetic element relative to said sensor means;

electrical circuit means including an electrical source coupled with said sensor means and responsive to the magnitude of said first and second deviation signals to produce respective first and second drive signals of proportionate magnitude;

hydraulic control means coupled with said hydraulic cylinder and including electrical drive means operative in response to the magnitude of said first drive signal to direct a proportionate hydraulic fluid flow to one end of said hydraulic cylinder to rotate said control arm means in one direction towards a predetermined angle and operative in response to the magnitude of said second drive signal to direct a proportionate hydraulic fluid flow to the opposite end of said cylinder to rotate said control arm means in the opposite direction toward said predetermined angle whereby when said earth mover encounters an uneven rise or depression causing its blade to be raised or lowered thus raising or lowering said control arm means relative to said predetermined angle, said magnetic element in assuming a position in the true vertical plane will be correspondingly shifted with respect to said predetermined transverse plane causing said sensor means to generate said respective first or second deviation signals thus causing said electrical control circuit to generate said respective first or second drive signal to thus cause said hydraulic control means to direct fluid flow to said respective first or second end of said cylinder to cause said control arm to be driven back toward said predetermined angle.

2. An earth mover blade stabilizing apparatus according to claim 1 wherein:

said sensor means includes a pair of sensors, one disposed, equidistant on either side of said predetermined transverse plane; and said electric control circuit includes an operational amplifier connected in a differential configuration and having its input terminals connected with the respective sensors for receiving said respective first and second deviation signals therefrom and operative in response thereto to generate said respective first and second drive signals to, when said magnetic element is shifted in said first or second direction out of said predetermined transverse plane, generate respective drive signals having a polarity indicative of said respective first and second directions and to generate a null signal when the predetermined transverse plane coincides with the true vertical plane.

3. An earth mover blade stabilizing apparatus according to claim 1 wherein:

said control circuit includes bias means coupled with said sensor means and including bias actuating means, said bias means being operative in response to actuation of said actuating means to apply a selected electronic bias to said circuit to bias said first and second control signals to thereby cause said hydraulic control means to cause said hydraulic cylinder to maintain said control arm rotated a selected angle from said predetermined angle.

4. The earth mover blade stabilizing apparatus of claim 1 that includes:

a control panel mounted on said earth mover and wherein;

said bias actuating means include an incrementally positionable control knob mounted on said control panel and, calibrated in degrees of angle corresponding to said selected angle relative to the predetermined angle.

5. The earth mover blade stabilizing apparatus of claim 1 wherein:

said sensor means includes a Linear Output Hall Effect Transducer.

6. The earth mover blade stabilizing apparatus of claim 1 wherein:

said sensor means includes a pair of Linear Output Hall Effect Transducers, one disposed equidistant on either side of said predetermined transverse plane.

7. The earth mover blade stabilizing system of claim 1 wherein:

said hydraulic control means includes a proportional valve and a proportional valve amplifier responsive to the magnitude of said first and second drive signals to proportionally control the opening of said proportional valve.

8. The earth mover blade stabilizing system of claim 1 wherein:

said control circuit includes an override switch operative to remove said sensor means from said circuit, and manual switch means for electrically coupling said electrical drive means in circuit with said electrical source.

9. An earth mover blade stabilizing apparatus for controlling the height of a blade carried from an earth mover by means of pivoted arm means rotatable about a transverse mounting axis and driven by a hydraulic cylinder, said apparatus comprising:

an inclinometer including a housing mounted on said arm means in a predetermined transverse plane and including sensor means disposed within said housing, said inclinometer further including a pendulum mounted from said housing for rotation about a pendulum axis disposed in said transverse plane, said pendulum naturally assuming a true vertical position not necessarily coplanar with the predetermined transverse plane, and including on the free end of said pendulum a magnetic element for generating a magnetic field, said sensor means for sensing said magnetic field, and operative in response to the location of said magnetic element on first and second sides of said predetermined transverse plane to produce respective first and second deviation signals indicative of the position of said magnetic element relative to said sensor means;

electrical circuit means including an electrical means coupled with said sensor means and responsive to said first and second deviation signals to produce respective first and second drive signals;

hydraulic control means including a proportional valve and a proportional valve amplifier coupled with said hydraulic cylinder and including electrical drive means operative in response to said first drive signal to direct a proportionate amount of hydraulic fluid to one end of said hydraulic cylinder to rotate said control arm means in one direction towards a predetermined angle and operative in response to said second drive signal to direct a proportionate amount of hydraulic fluid to the opposite end of said cylinder to rotate said control arm means in the opposite direction toward said predetermined angle whereby when said earth mover encounters an uneven rise or depression causing its blade to be raised or lowered thus raising or lowering said control arm means relative to said predetermined angle, said magnetic element in assuming a position in the true vertical plane will be correspondingly shifted with respect to said predetermined transverse plane causing said sensor means to generate said respective first or second deviation signals thus causing said electrical control circuit to generate said respective first or second drive signal to thus cause said hydraulic control means to direct fluid flow to said respective first or second end of said cylinder to cause said control arm to be driven back toward said predetermined angle.

10. An earth mover blade stabilizing apparatus according to claim 9 wherein:

said sensor means includes a pair of sensors, one disposed, equidistant on either side of said predetermined transverse plane; and said electrical control circuit includes an operational amplifier connected in a differential configuration and having its input terminals connected with the respective sensors for receiving said respective first and second deviation signals therefrom and operative in response thereto to generate said respective first and second drive signals to, when said magnetic element is shifted in said first or second direction out of said predetermined transverse plane, generate respective drive signals having a polarity indicative of said respective first and second directions and to generate a null signal when the predetermined transverse plan coincides with the true vertical plane.

11. An earth mover blade stabilizing apparatus according to claim 9 wherein:

said sensor means is operative in response to the magnitude of said magnetic element that is moved in said first and second directions from said predetermined transverse plane to generate said first and second deviation signals of proportionate magnitude;

said electrical control circuit includes means responsive to the magnitude of said first and second deviation signals to generate said first and second drive signals of proportionate magnitude; and said electric drive means includes means operative in response to the magnitude of said respective first and second drive signals to supply hydraulic fluid at a proportionally higher rate of flow to the respective opposite ends of said hydraulic cylinders.

12. An earth mover blade stabilizing apparatus according to claim 9 wherein:

said control circuit includes bias means coupled with said sensor means and including bias actuating means, said bias means being operative in response to actuation of said actuating means to apply a selected electronic bias to said circuit to bias said first and second control signals to thereby cause said hydraulic control means to cause said hydraulic cylinder to maintain said control arm rotated a selected angle from said predetermined angle.

13. The earth mover blade stabilizing apparatus of claim 9 that includes:

a control panel mounted on said earth mover and wherein:

said bias actuating means include an incrementally positionable control knob mounted on said control panel and, calibrated in degree of angle corresponding to said selected angle relative to the predetermined angle.

14. An earth mover blade stabilizing apparatus of claim 9 wherein:

said sensor means includes a Linear Output Hall Effect Transducer.

15. The earth mover blade stabilizing apparatus of claim 9 wherein:

said sensor means includes a pair of Linear Output Hall Effect Transducers, one disposed equidistant on either side of said predetermined transverse plane.

16. The earth mover blade stabilizing system of claim 9 wherein:

said control circuit includes an override switch operative to remove said sensor means from said circuit. and manual switch means for electrically coupling said electrical drive means in circuit with said electrical source.

* * * * *